United States Patent [19]

Fiedler et al.

[11] Patent Number: 4,944,224

[45] Date of Patent: Jul. 31, 1990

[54] ELECTRICAL IGNITING MEDIUM

[75] Inventors: Kurt Fiedler, Diepersdorf; Bernhard Kratz, Wendelstein; Gerhard Kordel, Nurnberg; Gerrit Scheiderer, Furth, all of Fed. Rep. of Germany

[73] Assignees: Diehl GmbH & Co., Nurnberg; Dynamit Nobel Aktengesellschaft, Troisdorf, both of Fed. Rep. of Germany

[21] Appl. No.: 337,616

[22] Filed: Apr. 10, 1989

[30] Foreign Application Priority Data

Apr. 19, 1988 [DE] Fed. Rep. of Germany ..... 3812958

[51] Int. Cl.[5] ..... F42B 3/18; F42B 3/182

[52] U.S. Cl. ..... 102/202.2

[58] Field of Search ..... 102/202.2

[56] References Cited

U.S. PATENT DOCUMENTS

| | | | |
|---|---|---|---|
| 3,572,247 | 3/1971 | Warshall | 102/202.2 |
| 4,152,988 | 5/1979 | Haas et al. | 102/202.5 |
| 4,592,280 | 6/1986 | Shores | 102/202.2 |
| 4,690,056 | 9/1987 | Brede et al. | 102/202.2 |
| 4,779,532 | 10/1988 | Riley et al. | 102/202.2 |

FOREIGN PATENT DOCUMENTS

| | | |
|---|---|---|
| 150823 | 1/1985 | European Pat. Off. . |
| 3637988 | 5/1988 | Fed. Rep. of Germany . |
| 635673 | 12/1978 | Switzerland . |
| 1368223 | 9/1974 | United Kingdom . |
| 1488893 | 10/1977 | United Kingdom . |
| 2006402 | 5/1979 | United Kingdom . |
| 2057645 | 4/1981 | United Kingdom . |

*Primary Examiner*—Charles T. Jordan

*Attorney, Agent, or Firm*—Scully, Scott, Murphy & Presser

[57] ABSTRACT

An igniting medium incorporating a support member, the latter of which is passed through by electrical leads extending towards an ignition bridge. The support member is constructed as a shunt-capacitance which is connected to the electrical lead lines for the ignition bridge.

12 Claims, 3 Drawing Sheets

ELECTRICAL IGNITING MEDIUM

BACKGROUND OF THE INVENTION

1. Field of the Invention The present invention relates to an igniting medium incorporating a support member, the latter of which is passed through by electrical leads extending towards an ignition bridge.

Within the concept of the present invention, pertaining to the designation ignition medium, it must be understood that this includes, within the broadest context, ignition or detonator elements (especially, inclusive their embodiments as primer capsules or ignition matches, as primer cap ignition elements, or as detonating media with outputs of direct explosive force), such as igniters or detonators which are built into electropyrotechnic triggers.

2. Discussion of the Prior Art

An igniting medium in the constructional configuration of a primer capsule or electric match is known from the disclosure of U.S. Pat. No. 4,152,988. Electrically-actuatable pyrotechnic power elements, also designated as electric triggers, such as are widely employed; for instance, as singly employable or non-reusable block-switch means for fuze safety devices, are currently being marketed by the Dynamit Nobel Aktiengesellschaft, West Germany.

It is common to all of these igniting media that the supplying of an electric current leads to a pyrotechnic triggering. However, it is always problematic that under inexpedient environmental conditions it is impossible to preclude the straying in or accumulation of high-frequencied interference radiation energy into the electrical lead lines, which can be already sufficient to cause a triggering; with the result that the triggering of the igniting or detonating medium at the inappropriate time, will be carried out in an uncontrolled manner and, for example, produces malfunctions and endangers personnel or articles.

As a remedy against such a type of triggering caused by interference radiation, it is known that the electrical actuation can be undertaken through a high-frequency filter circuit which is inserted during the course of wiring for the igniting medium lead lines, and which should be able to block off or short-circuit the high-frequencied interference energy A circuit of this kind is usually connected in closest possible proximity to the inlet for the electrical lead lines into the support member for igniting medium (which can be designed as a pole or terminal member for an ignitor or detonator bridge or as the restraining disc of a sleeve encapsulation). However, in this case the danger is only reduced but not precluded, in that high-frequencied interference energy is still coupled in between the filter circuit and the actual igniting medium and thereby leads to an undesired triggering. As a consequence thereof, in Swiss Patent No. 635 673 provision is made, for an ignition element, that on a substrate or carrier member itself of an insulating material, and immediately adjacent the contacting for the ignition bridge to implement the provision of these circuits which are ordinarily constructed as actuating and filter circuits in the lead lines for the igniting medium in the distinct circuitry technology. As a result, to some extent there is obtained an intelligent igniting or detonating medium; namely, an igniting medium without the requirement for the separate connection ahead thereof of auxiliary and safety circuits. Such a type of implementation necessitates, at all times, on one hand, a significant demand on manufacturing technology.

When the detonating medium is a component of the so-called electrical trigger (pyrotechnic power element), the direct installation of a filter circuit on a substrate or support member is also subject to the disadvantageous result in that the standardized trigger, which is already accepted in its type of structure and is already in use, may no longer be employed without any new time-consuming and costly acceptance procedures inasmuch as a modification which is essential to its functioning must be undertaken directly within the interior of the igniting or detonating medium.

SUMMARY OF THE INVENTION

Accordingly, in recognition of these conditions, it is an object of the present invention to equip ignition or detonator media of the type under consideration herein with the most possibly effective high-frequency interference protective measures without any technologically critical modification in the interior of the ignition medium itself. Hereby, there should especially also be opened the capability that through the positioning of the high-frequency interference protective measure as closely as possible to the ignition bridge, that no modifications need to be undertaken within the interior of the electrical trigger which are essential to the functioning thereof, in effect, notwithstanding the possibility of eliminating any external additions of protective measures against interferences, and to thereby avoid the need for any new acceptance tests.

The foregoing object is inventively achieved in that the detonator or ignition medium of the type which is under consideration herein has the support member therefor constructed as a shunt-capacitance which is connected to the electrical lead lines for the ignition bridge.

The foregoing object is predicated on the recognition that the support member, which is usually already present for an igniting medium (irrespective as to whether it is the pole member of a primer capsule or of an electric match, or simply the retainer plate for a power element-encapsulation), of a suitable material selection with regard to the dielectric properties, is directly adapted for the formation of a shunt-capacitance as a high-frequency short-circuit at the electrical lead line inlet into the casing for the igniting medium. Thereby, on the one hand, the high-frequency short-circuit lies extremely close to the ignition bridge, which for the remainder is screened-off by the metallic encapsulation against interference radiation; whereas, on the other hand, for these interference protective measures there are not required any kind of mechanical modifications which are essential to the functioning within the interior of the encapsulated igniting medium.

In the instance of the implementation of the inventive object for a pyrotechnic power element, the brass ring which heretofore was usually a retainer disc, which is flanged into the foot end of the encapsulating casing, needs practically only to be replaced by a shunt-capacitance dielectic medium, which carries electrode systems which are electrically connected to the lead lines. Basically, the two electrodes can be constructed as hemihedral surfaces in effect, having half the faces required for complete symmetry, provided on an end surface of this shunt-capacitance retainer disc, or on the two oppositely located end surfaces of a ceramic plate of high dielectric constants. A higher value for the shunt-capacitance at preset installing dimensions for the retainer disc (for instance, such a support member for igniting or detonator media for other purposes of application) is, however, obtained when the shunt-capacitance is produced from a multiplicity of thin ceramic layers with electrodes interposed therebetween (for example, vapor-deposited or coated or laminated thereon) which alternatingly; in effect, comb-like interengagingly, are interconnected with the pair of electrode systems which, in turn, are load-transmissively or close-fittingly, or in any event electrically-conductively, connected with the respectively associated electrical lead line. In effect, a support member with that type of integrated shunt-capacitance provides the highest-effective protection against any undesired triggering of the detonator medium through high-frequency interference influences, for which purpose it is only necessary to carry out a minimal modification with respect to the introduced type of structure of the applicable ignition or detonator medium, and especially because of no modification to the functionally essential mechanics of a power element, but only to the periphery of the structure, there is no requirement for any new qualification procedure for the military acceptance for the type of construction of an already introduced trigger. The additional installation and electrical connection of protective circuits during the utilization of such types of power elements is thereby obviated, which leads to a reduced assembling requirement and a greater operational reliability.

When, pursuant to the preferred example of utilization of the inventively configured igniting medium with the shunt-capacitance integrated in its support member, the ignition medium itself must be movable relative to the support member which serves as a retainer disc, then there must be provided either a slidable leading-in of the electrical lead lines through the shunt-capacitance; or in the interest of attaining a higher operating security, the lead lines are soldered to the shunt-capacitance electrodes, and are conducted within the encapsulation either looped-shaped arcuately, so as to be capable (in accordance with the relative movement between the ignition medium and the retainer disc) of being either extended or compressed during the movement of the ignition or detonator medium.

The inventive measures can be obtained in the same measure for single-poled or two-poled electrical activation of the ignition medium: in essence, independently as to whether, for the closing of the electrical circuit by means of ignition bridge, a second lead line extends through the support member, or as to whether the encapsulating casing itself serves as a return conductor.

BRIEF DESCRIPTION OF THE DRAWINGS

Reference may now be had to the following detailed description of preferred embodiments of the invention elucidating additional alternatives and modifications thereof, as well as further features of the inventive object, and generally schematically illustrating the preferred embodiments, taken in conjunction with the accompanying drawings; in which.

DETAILED DESCRIPTION

Figure 1:
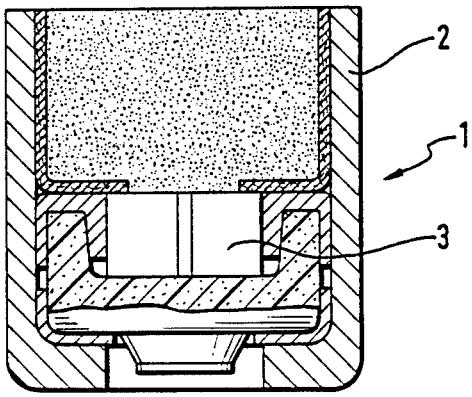
FIG. 1 illustrates an electrical detonator or ignition medium in the constructional configuration of a fuze or primer cap.
Figure 2:
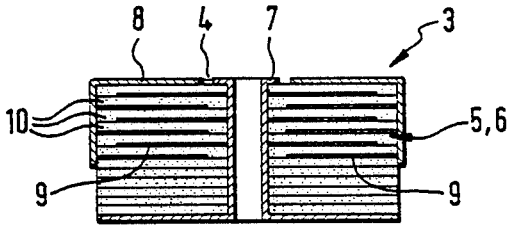
FIG. 2 illustrates a detonator element with a shunt-capacitance integrated in the support member thereof for a primer cap pursuant to FIG. 1.

FIG. 1 illustrates through a simplified representation in an axial longitudinal section, an electrical detonating medium 1 in the constructional shape of a primer cap 2, whose igniting element 3 is illustrated by a symbolically simplified ignition bridge 4, as shown in the more specific axial longitudinal section of FIG. 2. The support member 5 of the igniting element 3 serves as the shunt-capacitance 6 which is electrically connected in parallel with the ignition bridge 4, constructed between terminals 7 and 8 for, on the one side, the capacitor electrodes 9 and, on the other side, the ignition bridge 4.

In order to achieve for a sufficiently large shunt-capacitance, the sufficiently large surface for electrodes 9 which stand as closely as possible opposite each other, the support member 5 is built up from a coaxial stack of individual disc-shaped layers 10 from a material of the highest possible dielectric constants, onto which there is presently applied an electrode 9 (for example, imprinted or vapor-deposited). Especially adapted for these layers 10 is a material which is already on the market; for example, which is obtainable from the company Murata, and which is the flexible and imprintable so-called "X7R-Ceramic".

The axially spaced electrodes 9, because of an alternating radial displacement (as can be ascertained from the sectional view of FIG. 2) are assembled into two comb-shaped interengaging electrode systems, in that they are alternatingly conducted along a central terminal 7 and along the peripheral terminal 8 and are electrically-conductively joined together at that location. Such a support member 5 which, for example, is of 2 mm height and 3.7 mm diameter with the integrated shunt-capacitance 6 as illustrated, has a capacitive value in the magnitude of 15 nF to 20 nF, and consequently a sufficient high-frequency short-circuit in parallel with the detonator or igniting bridge 4.

Figure 3:
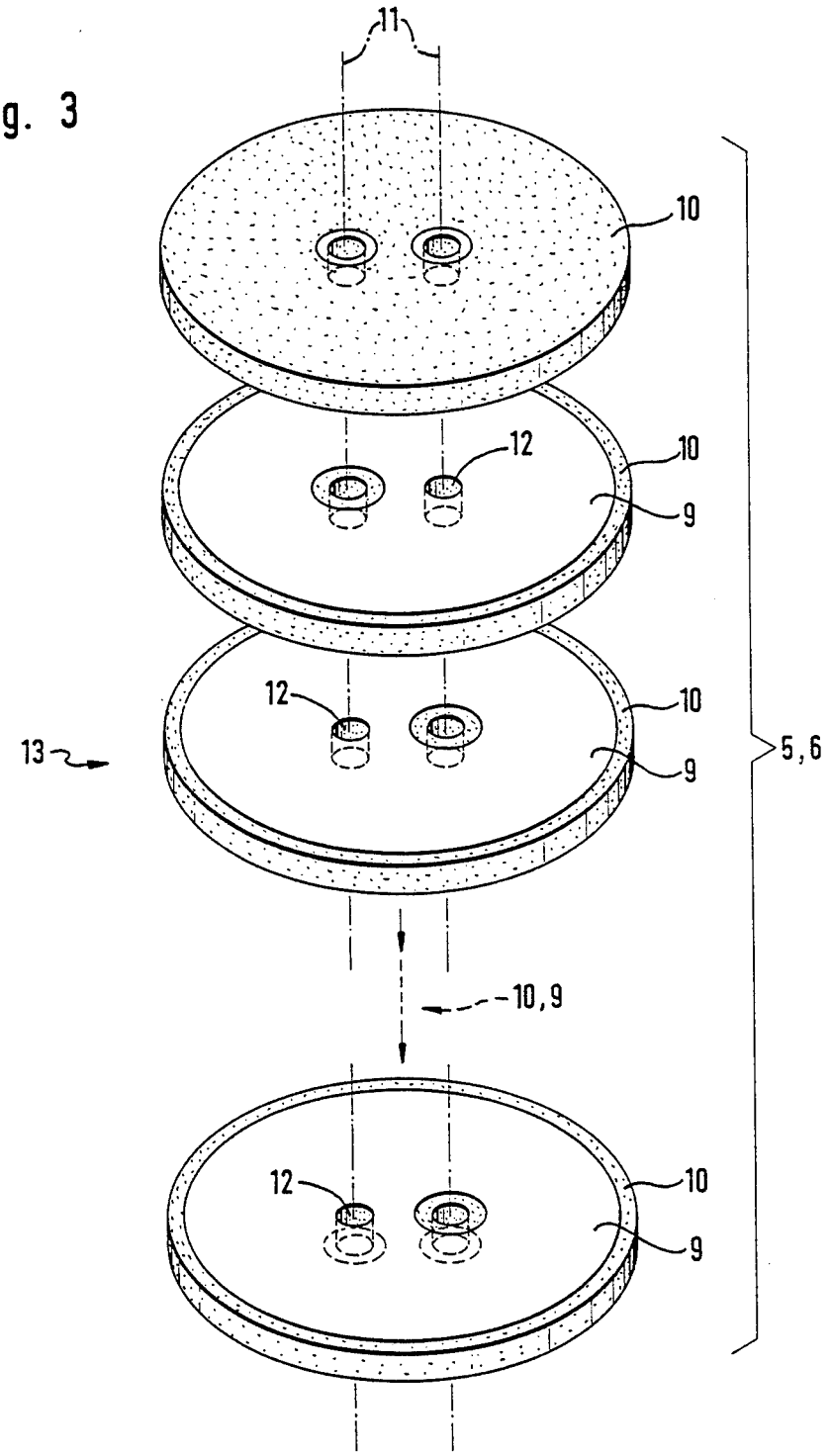
FIG. 3 illustrates, in an exploded perspective view, the arrangement of the layers for a support member with an integrated shunt-capacitance pursuant to FIG. 2.

However, pursuant to FIG. 3, the individual electrodes 9 of the superimposed ceramic layers 10 can also be built up through axially-parallel lead lines 11 extending thereacross, and eccentric therewith alternating contacting apertures 12 extending towards the support member 5 with integrated shunt-capacitance 6. This contacting is of particular advantage for the installation of such a support member 5 with integrated shunt-capacitance 6 as the pole member 13 of an electrical detonator medium 1 in the structure of a primer capsule 14, such as is encapsulated in a casing 15; for example, pursuant to FIG. 4, whose foot end 16 is closed off by the inwardly flanged pole member 13. The actual carrier 17 for the detonator bridge 4 is retained in the interior of the casing 15 by the ends of the lead lines 11 which extend through the pole member 13.

The structure of the support member 5, herein employed as the pole member 13, again serves as a lamellar capacitance with a shunt-capacitance 6 between the lead lines 11 for the shunting-off of any coupled-in higher-frequencied interference energy, so as to avoid the detonator bridge 4 from being already triggered through such interferential influences.

Figure 4:
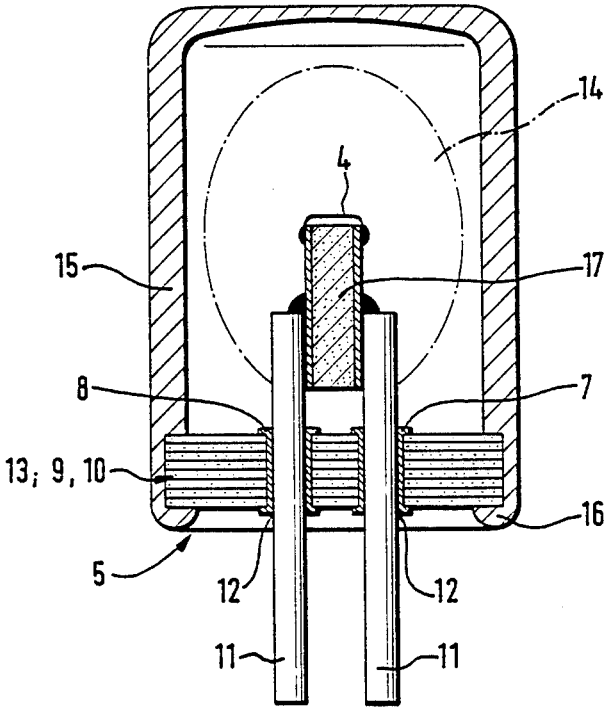
FIG. 4 illustrates a support member with integrated shunt-capacitance as the pole member of an electrical detonator or primer capsule.
Figure 5:
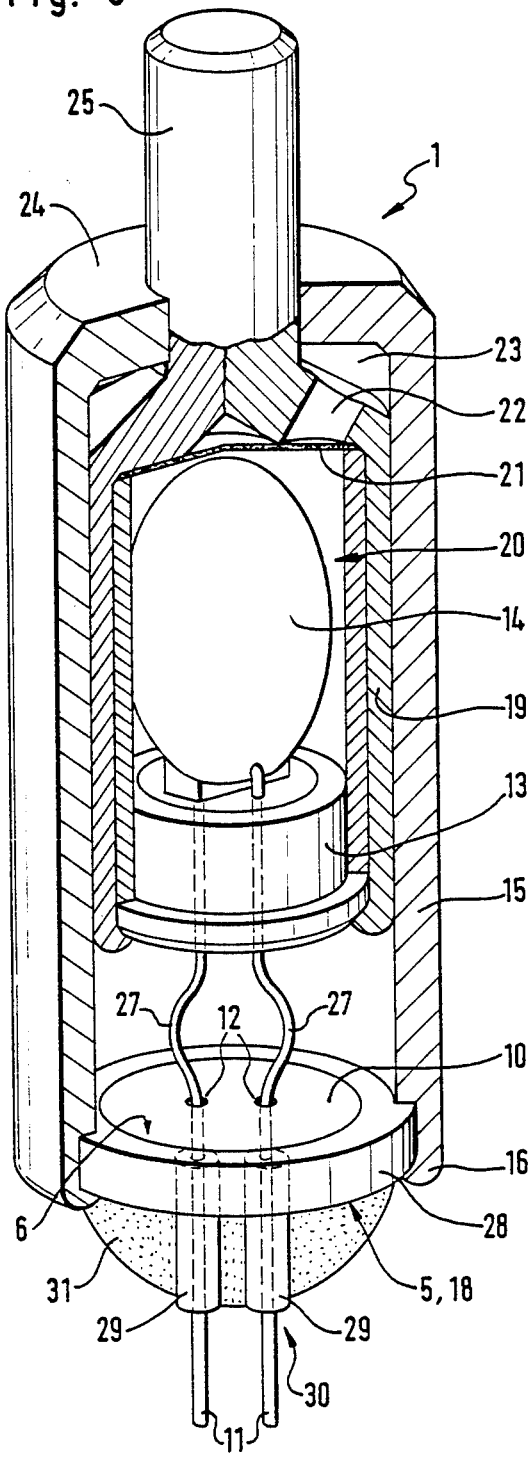
FIG. 5 illustrates a pyrotechnic detonator medium in conformance with the primer capsule of FIG. 4, utilized as the active component of a power element for a trigger retracting latching piston, in the implementation of the support member with integrated shunt-capacitance as the retainer disc for the encapsulating casing of the power element.

In the exemplary embodiment pursuant to FIG. 5, an encased detonator capsule 14 which is configured somewhat according to FIG. 4, which is axially displaceable within an outer casing 15, and serves as the power or energy source for a detonator medium 1 which is designed as an electrical trigger (also designated as an electrically-activatable pyrotechnic power element) with a retractable piston or plunger. The support member 5 with integrated shunt-capacitance 6, in the exemplary embodiment pursuant to FIG. 5, however, is not the detonator capsule-pole member 13, but the retainer disc 18 which is flanged into the foot end 16 of the outer casing 15. A hollow piston 19 is retained so as to be axially displaceably along the inner mantle surface of the outer casing 15, and which encompasses the detonator or igniting medium 1. This possesses a detonating charge 20 on its pole member 13 which surrounds the primer capsule 14. Upon the electrical supplying of the lead lines 11, the red-hot bridge wire triggers the detonating charge 20 by means of the capsule 14. The development of incendiary reaction gases allows for the bursting of a covering 21 for the hollow piston 19, so that the gases pass through a passageway 22 into an expansion chamber 23 in the pressure-tightly sealed end 24 of the outer casing 15, and to build up a pressure between the end surface 24 as well as the hollow piston 19 for an axial displacement towards the foot end 16 of the casing. Thereby, a piston-like latching pin 25 which is connected with the hollow piston 19 and which extends coaxially from the casing end surface 24, is drawn from its initial position (as shown in the drawing) in conformance with the extent of the movement of the hollow piston 19, into the casing 15.

Figure 6:
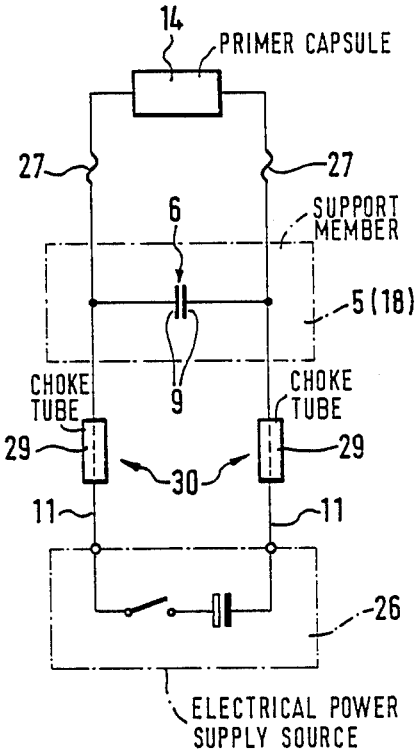
FIG. 6 illustrates a two-poled electrical replacement circuit diagram for the electrical activation of an ignition bridge with a parallel-connected shunt-capacitance which is integrated in a support member.

In order to avoid the undesired electrical triggering of the detonator capsule 14 due to higher-frequencied interference energy radiated or otherwise coupled into the electrical lead lines 11, but only through controlled activation from an electrical power supply source 26 (FIG. 6), there is again arranged the shunt-capacitance 6 between the lines 11—11, and as closely as possible ahead of the detonator capsule 14, for the short-circuiting of higher-frequencied energy components. The inwardly located electrodes 9 are not illustrated in FIG. 5. However, also the end surfaces of the retainer disc 18 which is of an electrically insulating material can be covered with electrodes 9.

As already indicated hereinabove (FIG. 3), the respective electrical connection between the electrodes 9 and the lead lines 11 can be effectuated in that the apertures 12 are printed through, as is known from the technology pertaining to printed-circuit boards; with the connections of the electrodes 9 directly to the aperture printings. Hereby, there can be formed a mechanical sliding pressure enclosure for the lead lines 11 which are conducted uninsulatedly through the apertures 12. However, there can also be provided a direct solder bridge connection between the electrodes 9 and the region of the respective lead lines 11 which pass through the apertures 12.

As is represented pursuant to the preferred example of utilization, when the detonator medium 1 (as the power-delivering element of a blocking-trigger) is encapsuled so as to be displaceable relative to the outer casing 15 and its retainer disc 18, with the mechanical positioning of the lead lines 11 in the retainer disc 18 which is constructed as a shunt-capacitance 6, there is then effected an expedient mechanical positioning of the lead lines 11 in the apertures 12 with the prerequisite of a baffle plate, for example, a compressive bend 27 in each of the lead lines 11 across the retainer disc 18.

This bend 27 affords for a defined outward bulging during the compression of the lead lines 11 as a result of the reducing narrow spacing between the retainer disc 18 and the approaching hollow piston 19; so that any movable guidance for the lead lines 11 through the retainer disc 18 is no longer required, which could adversely influence the secure electrical connection of the lead lines 11 with electrodes 9 of the shunt-capacitance 6. At a shifting operative movement of the piston 19, the length of the bends 27 is dimensioned in such a manner that the outward shifting movement is not limited by any tautly tensioned lead lines 11.

In order to avoid any damaging of the shunt-capacitance 6; in essence, the ceramic layers 10, during the flanging-in of the foot end 16 of the casing, it can be expedient to enclose the periphery thereof by a stable protective ring 28, as is considered in FIG. 5.

As an additional protective measure against interferences, it can be advantageous that, externally of the retainer disc 18, choke tubes 29 can also be slid onto the lead lines 11, such as small tubes from a highly-permeable material such as ferrite, and to thereby form two longitudinal inductivities 30 as high-ohmic high-frequency impedances directly ahead of the shunt-capacitance 6. These choke tubes 29 are expediently mechanically retained through a plastic material embedding 31 in front of the outside of the retainer disc 18, and are protected from bending stresses as well as from environmental influences.

What is claimed is:

1. Electrical detonator or igniting medium, comprising a support member; electrical lead lines extending towards a detonator bridge and passing through said support member, said support member forming a shunt-capacitance which is connected to the lead lines for the detonator bridge, and said shunt-capacitance including ceramic layers which are equipped with electrodes.

2. A detonator medium as claimed in claim 1, wherein said electrodes are alternatingly contacted with said lead lines.

3. A detonator medium as claimed in claim 1, wherein said shunt-capacitance is enclosed within a protective ring.

4. A detonator medium as claimed in claim 1, wherein the electrical activation of the detonator bridge is effectuated through one of said lead lines and an encapsulating casing.

5. A detonator medium as claimed in claim 1, wherein the actuation of the detonator bridge is effectuated through two said lead lines extending through the support member.

6. Electrical detonator or igniting medium, comprising a support member; electrical lead lines extending towards a detonator bridge and passing through said support member, said support member forming a shunt-capacitance which is connected to the lead lines for the detonator bridge, said detonator comprising an igniting element for a primer cap, with the formation of said shunt-capacitance in a laminated support member with central and peripheral structure of terminals for electrodes.

7. Electrical detonator or igniting medium, comprising a support member; electrical lead lines extending towards a detonator bridge and passing through said support member, said support member forming a shunt-capacitance which is connected to the lead lines for the detonator bridge, said support member being a detonator capsule with the structure of said shunt-capacitance being a pole member thereof, and which includes at least one through-aperture for said lead lines, said aperture being contacted therethrough and being electrically connected with each second layer of a plurality of layered electrodes and an associated lead line of said lead lines.

8. Electrical detonator or igniting medium, comprising a support member; electrical lead lines extending towards a detonator bridge and passing through said support member, said support member forming a shunt-capacitance which is connected to the lead lines for the detonator bridge; said medium being a triggering element in a mechanical switching and latching element, said shunt-capacitance being integrated in a retainer disc for a casing, and a primer capsule being displaceable within the casing relative to said disc.

9. A detonator medium as claimed in claim 8, wherein the retainer disc is axially displaceable relative to a shunt-capacitance electrode through a lead line extending through an aperture under frictional and electrical contacting.

10. A detonator medium as claimed in claim 8, wherein the retainer disc is electrically-conductively rigidly connected with a shunt-capacitance electrode through a lead line passing through an aperture.

11. A detonator medium as claimed in claim 10, wherein the lead line extending through the retainer disc is connected along an arc to a primer capsule which is axially displaceable within an outer casing.

12. Electrical detonator or igniting medium, comprising a support member; electrical lead lines extending towards a detonator bridge and passing through said support member, said support member forming a shunt-capacitance which is connected to the lead lines for the detonator bridge; choke tubes being slid onto the lead lines in front of the entry of the lead lines into an aperture formed in the support member, said choke tubes being protected through a plastic embedding against environmental influences and being connected with said support member.

* * * * *